US006712067B1

(12) United States Patent
Barbour et al.

(10) Patent No.: US 6,712,067 B1
(45) Date of Patent: Mar. 30, 2004

(54) PORTABLE COOK STOVE WITH A REVERSIBLE GRATE AND METHOD OF USING THE SAME

(75) Inventors: Rodney A. Barbour, Brandon, MS (US); Wayne Alvin Neal, Jackson, MS (US)

(73) Assignee: Barbour International, Inc, Brandon, MS (US)

( * ) Notice: Subject to any disclaimer, the term of this patent is extended or adjusted under 35 U.S.C. 154(b) by 0 days.

(21) Appl. No.: 10/249,459

(22) Filed: Apr. 11, 2003

(51) Int. Cl.[7] ..... F24C 15/10
(52) U.S. Cl. ..... 126/215; 126/214 C; 126/24
(58) Field of Search ..... 126/214 R, 214 C, 126/215, 9 R, 9 B, 24, 40, 50, 41 R, 38; D7/407, 408, 409, 332; 219/432, 433, 458, 459; 248/346.01

(56) References Cited

U.S. PATENT DOCUMENTS 730,268 A * 6/1903 Keller ..... 126/39 H
2,161,496 A * 6/1939 Wolcott ..... 126/214 R
5,065,735 A * 11/1991 Bourgeois et al. ..... 126/40
5,372,121 A * 12/1994 Castillo et al. ..... 126/214 R
6,588,417 B2 * 7/2003 Jones et al. ..... 126/215

* cited by examiner

*Primary Examiner*—James C. Yeung
(74) *Attorney, Agent, or Firm*—McGarry Bair PC

(57) ABSTRACT

A portable cook stove is provided with a cooking pot support having upstanding peripheral tabs at a peripheral portion thereof. When a cooking pot having an effective pot diameter at or less than an effective inner diameter of the tabs is employed, the cooking pot support can be oriented so that the upstanding peripheral tabs are directed upwardly creating a guard against slippage of the cooking pot with respect to the cooking pot support. Conversely, when a cooking pot having an effective pot diameter greater than the effective inner diameter of the tabs is employed, the cooking pot support can be oriented so that the peripheral tabs are directed downwardly and do not create an obstruction to using the larger cooking pot.

20 Claims, 13 Drawing Sheets

PORTABLE COOK STOVE WITH A REVERSIBLE GRATE AND METHOD OF USING THE SAME

BACKGROUND OF INVENTION

1. Field of the Invention

The invention relates generally to a portable outdoor cook stove and, more particularly, to a portable outdoor cook stove with a removable and reversible grate for supporting and retaining cooking vessels thereon. The invention also contemplates a convenient packaging method for locating the grate within the confines of a suitably configured cook stove.

2. Description of the Related Art

Portable outdoor gas cook stoves are commonly used for camping, recreational vehicle, tailgating, and backyard cooking. In general, a cook stove comprises a vertically-open frame supported above the ground and a burner coaxially supported within the frame. The frame typically has a flat surface, such as a grate, on which a cooking vessel is placed so that the vessel is located above the burner and, therefore, heated by the burner. An example of a suitable cooking vessel is a tall stockpot, often used for boiling, deep frying, stewing, and other cooking methods.

Because cook stoves are frequently positioned on dirt, gravel, or some other type of uneven ground, the flat surface that supports the stockpot may not be level, and the stockpot can have a tendency to slide. Grates and stockpots are usually constructed of metallic materials, and low-friction metal-to-metal interaction does not create a suitable force to retain the stockpot in position. If the stockpot slides past the periphery of the cooker grate, it can completely fall off the cook stove, thus causing an undesirable situation.

SUMMARY OF INVENTION

The current invention addresses the aforementioned problems by providing a portable cook stove with a cooking pot support having upstanding peripheral tabs that, when oriented upwardly with respect to the cook stove base, retain cooking pots and other cooking vessels on the cooking surface of the cooking pot support. The invention is safe, versatile, convenient, and easy to use. For cooking pots wider than the cooking tabs, the grate can be reversed (or inverted) so that the tabs are oriented downwardly and, thus, the tabs do not obstruct the placement of a wider-diameter pot on the grate.

Specifically, the current invention is a portable cook stove adapted for supporting a cooking pot thereon, the cooking pot defining an effective pot diameter, comprising ground engaging base; a wall mounted to the base having a closed hoop configuration defining a periphery with an effective outer diameter, wherein the wall has an upper portion and defines a central opening therethrough, wherein the upper portion of the wall includes a discontinuous mounting portion; and a burner mounted to the wall in a generally coaxial configuration with the central opening, the burner adapted to be operably interconnected with a source of fuel. At least one cooking pot support is mounted to the wall in a generally transverse orientation to the wall and extends into the central opening, a portion of the cooking pot support received by the discontinuous mounting portion to prevent lateral movement of the cooking pot support with respect to the wall, the cooking pot support having a first cooking surface juxtaposed with a second cooking surface, the first cooking surface having an upstanding peripheral tab thereon defining an effective inner diameter; the at least one cooking pot support defining a cooking pot support surface for supporting the cooking pot thereon.

When a cooking pot having an effective pot diameter at or less than the effective inner diameter is employed, the cooking pot support can be oriented with respect to the wall so that the upstanding peripheral tabs are directed upwardly creating a guard against slippage of the cooking pot with respect to the cooking pot support, and when a cooking pot having an effective pot diameter greater than the effective inner diameter is employed, the cooking pot support can be oriented with respect to the wall so that the peripheral tabs are directed downwardly and do not create an obstruction to using the larger cooking pot.

The discontinuous mounting portion of the portable cook stove can comprise a plurality of grooves in the upper portion of the wall at radially-spaced intervals.

The cooking pot support of the portable cook stove can have at least one mounting portion in close alignment with the radially-spaced plurality of grooves in the upper portion of the wall, whereby when the mounting portion is positioned within the plurality of grooves, lateral movement of the cooking pot support with respect to the wall is resisted. The wall can have a square configuration. The cooking pot support can be configured so as to nest within the confines of the wall when canted at an angle with respect to the wall. The cooking pot support can be comprised of a latticework forming openings between adjacent lattices. The wall can also have a round configuration.

In another aspect, the invention relates to a portable cook stove comprising: a ground-engaging base with a wall upstanding therefrom, the wall defining an open central recess therethrough, the wall having at least one support mounting portion thereon at an upper portion thereof; a burner mounted to at least one of the base and the wall, the burner being positioned within the open central recess in the wall, the burner being operably connectable to a source of ignitable fuel; a cooking pot support having a first surface and an opposed second surface, each of the first surface and the second surface having at least one mounting portion in register with the at least one mounting portion on the wall, wherein the cooking pot support can be mounted generally transversely to the wall by receipt of the at least one mounting portion on one of the first and second surfaces with the at least one mounting portion on the wall, and wherein the cooking pot support has a guard extending upwardly from one of the first and second surfaces. The guard thereby prevents slidable movement of a cooking pot relative to the cooking pot support, when a cooking pot is placed onto the cooking pot support when the guard is oriented upwardly with respect to the one of the first and second surfaces.

The guard can comprise a plurality of upstanding tabs extending upwardly from a periphery of the one of the first and second surfaces. The mounting portion of the wall can comprise at least one groove in the upper portion of the wall which is adapted to receive a corresponding one of the at least one mounting portion on the cooking pot support. Each of the at least one groove in the wall can comprise a generally rounded rectangular groove. Each of the plurality of tabs can be generally flush with the periphery of the cooking pot support and extend upwardly from the one of the first and second surfaces.

In an additional aspect, the invention relates to a method of configuring a cook stove having a generally transverse cooking pot support at an upper portion thereof, the cooking pot support having an effective inner diameter, to function with cooking pots with both an effective pot diameter less than the effective inner diameter of the cooking pot support and greater than the effective inner diameter, the method comprising the steps of: providing a guard extending upwardly from one of a first surface and an opposed second surface of the cooking pot support, the guard defining the effective inner diameter of the cooking pot support on the one of a first surface and an opposed second surface of the cooking pot support; selecting a cooking pot having an effective cooking pot diameter desired to be employed with the cookstove; comparing the effective inner diameter of the cooking pot support with the effective cooking pot diameter; and orienting the cooking pot support on the cook stove so that the guard is pointing upwardly if the comparing step determines that the effective inner diameter is greater than the effective cooking pot diameter, and so that the guard is pointing downwardly if the comparing step determines that the effective inner diameter is less than the effective cooking pot diameter so that the guard does not obstruct placement of the cooking pot onto the cooking pot support.

The method can also further comprise the step of placing the selected cooking pot on the oriented cooking pot support. The method can also further comprise the step of operating the cook stove in a normal mode of use to prepare cooked food in the selected cooking pot. The method can also further comprise the step of reorienting the cooking pot support when a cooking pot of one of a lesser and greater diameter is later selected.

BRIEF DESCRIPTION OF DRAWINGS

The invention will now be described with reference to the drawings wherein.

DETAILED DESCRIPTION

Figure 1:
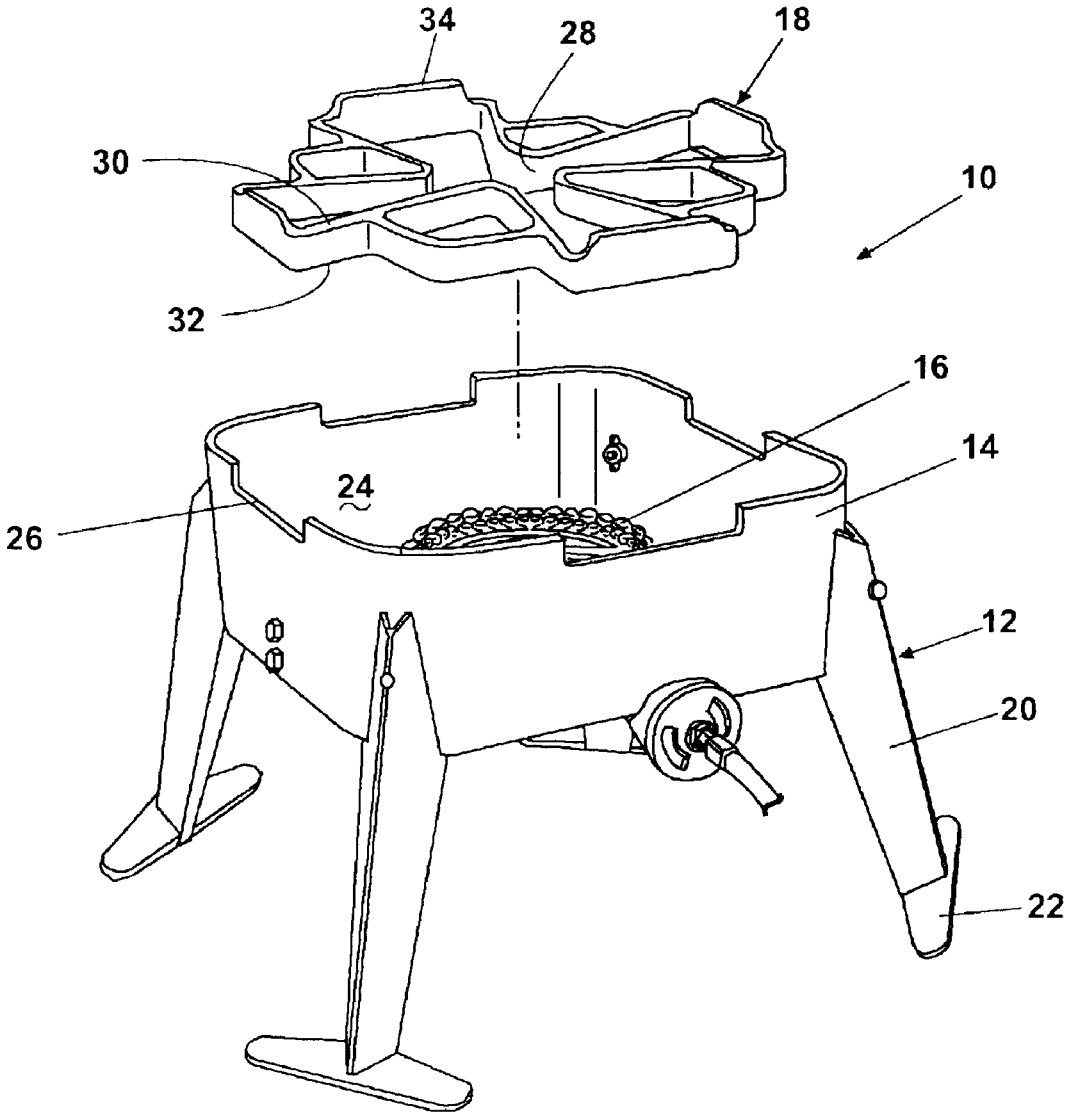
FIG. 1 is an exploded perspective view of a portable cook stove with a ground-engaging base connected to a vertically-open wall (shown by example in a generally square configuration) and a reversible cooking pot support having upstanding peripheral tabs, wherein the support is shown in a guard position with the upright peripheral tabs directed upward relative to the wall.
Figure 2:
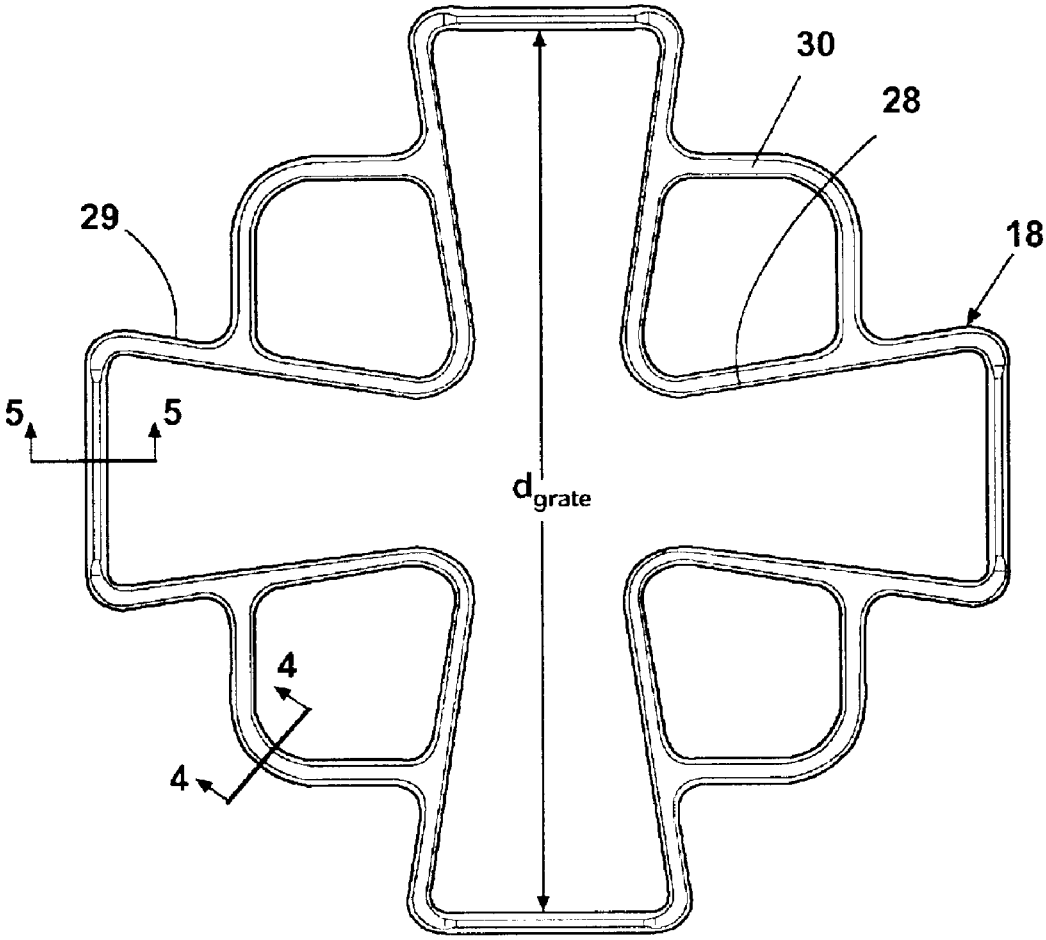
FIG. 2 is a top plan view of the cooking pot support in FIG. 1.

Referring now the drawings and FIG. 1 in particular, the current invention is a portable cook stove 10 comprising a cooking pot support 18 and a ground engaging base 12 having supporting legs 20, a vertically-open wall 14 (shown in an exemplary generally square configuration) mounted to the legs 20, and a burner 16 mounted to the wall 14 for upward direction of an emitted flame when the burner 16 is operably interconnected to a source of fuel, such as natural gas, in a manner which would be apparent to one skilled in the art.

The base 12 preferably has spaced legs 20 of triangular cross section orthogonally connected to feet 22 that rest on the ground or other surface; however, being that the portable cook stove is simply shown as a suitable example of a cook stove which might be used with the invention, any type or number of legs or posts suitable for supporting the cook stove 10 may be employed without departing from the scope of this invention.

The wall 14, which is mounted to the top of the legs 20, has a closed hoop configuration defining a periphery with an effective outer diameter and encompasses an upper portion defining a central opening 24 therethrough. Further, the upper portion of the wall 14 has a discontinuous mounting portion, shown by example in FIG. 1 as a plurality of discrete, elongated U-shaped mounting grooves 26 for retaining the cooking pot support 18. The wall 14 has at least one and, in the example shown in FIG. 1, four such grooves 26, one disposed on each side of the wall 14, but any reasonable number, size, or shape of grooves may be incorporated into the wall 14 of the cook stove 10 without departing from the scope of this invention. The burner 16 is mounted to the wall 14 in a generally coaxial configuration with the central opening 24.

The cooking pot support 18 in FIG. 1, and shown in detail in FIGS. 2–5, comprises a lattice-type metal grate 28 with a first cooking surface 30 disposed oppositely of a second cooking surface 32. The grate, preferably, is constructed of a steel alloy suitable to tolerate extremely high temperatures generated by the burner 16 and high stresses resulting from heavy loads such that the grate 28 maintains a flat, undistorted shape without warpage. Optionally, the cooking pot support 18 can be coated with a black substance. The lattice configuration need not be limited to the cross and square design shown in the figures; however, the lattice-type metal grate 28 must have at least one, and in the example shown in FIG. 1, four portions 29 that are formed integrally with or extend from the main body of the grate 28 such that the mating mounting portions 29 are sized to be received in the mounting grooves 26. The number of mounting portions 29 should correspond to the number of mounting grooves 28.

Figure 3:
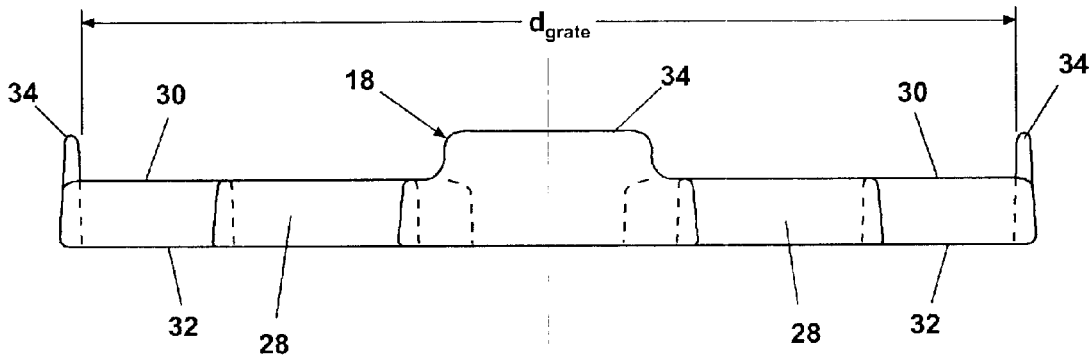
FIG. 3 is a side elevational view of the cooking pot support in FIG. 1.
Figure 4:
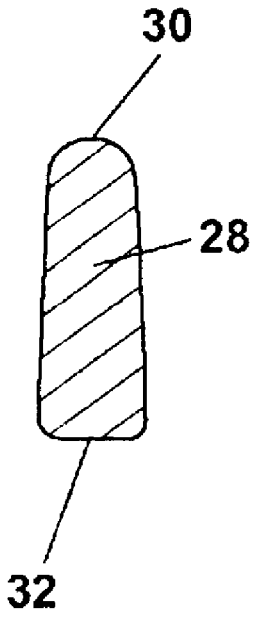
FIG. 4 is a sectional view of the cooking pot support taken along the line 4—4 of FIG. 2.
Figure 5:
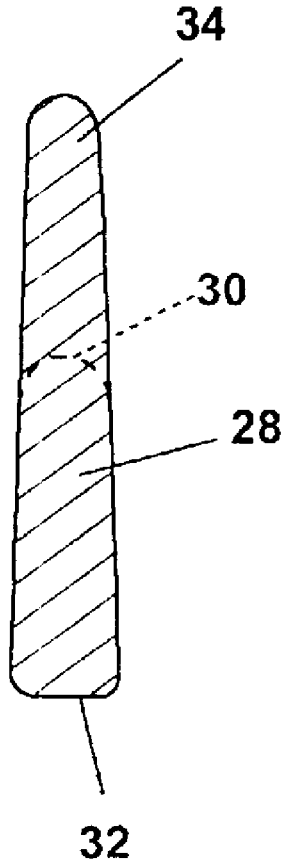
FIG. 5 is a sectional view of the cooking pot support taken along the line 5—5 of FIG. 2.

On the side of the grate comprising the first cooking surface 30, upstanding tabs 34 extend from the grate 28 at distal portions thereof to a distance slightly less than the height of the grate, which is defined as the distance between the first and second cooking surfaces 30, 32. The grate 28 preferably has a constant height, as seen in FIGS. 3 and 4, except for sections with the upstanding tabs 34, and the relative heights of the grate 28 and tabs 34 are illustrated in FIG. 5.

While it is preferable that the height of tabs 34 height is slightly less than that of the grate, the tabs 34 can have any height or shape capable of functioning as a guard as described herein. The tabs 34 are spaced at intervals around the periphery of the grate 28 and define an effective inner diameter $d_{grate}$, shown in FIGS. 2 and 3. Preferably, the tabs 34 are located on the extending portions 29, but they the tabs may be positioned anywhere along the periphery of the grate 28, and therefore, do not need to be located at the same intervals as the mounting grooves 26.

Figure 6:
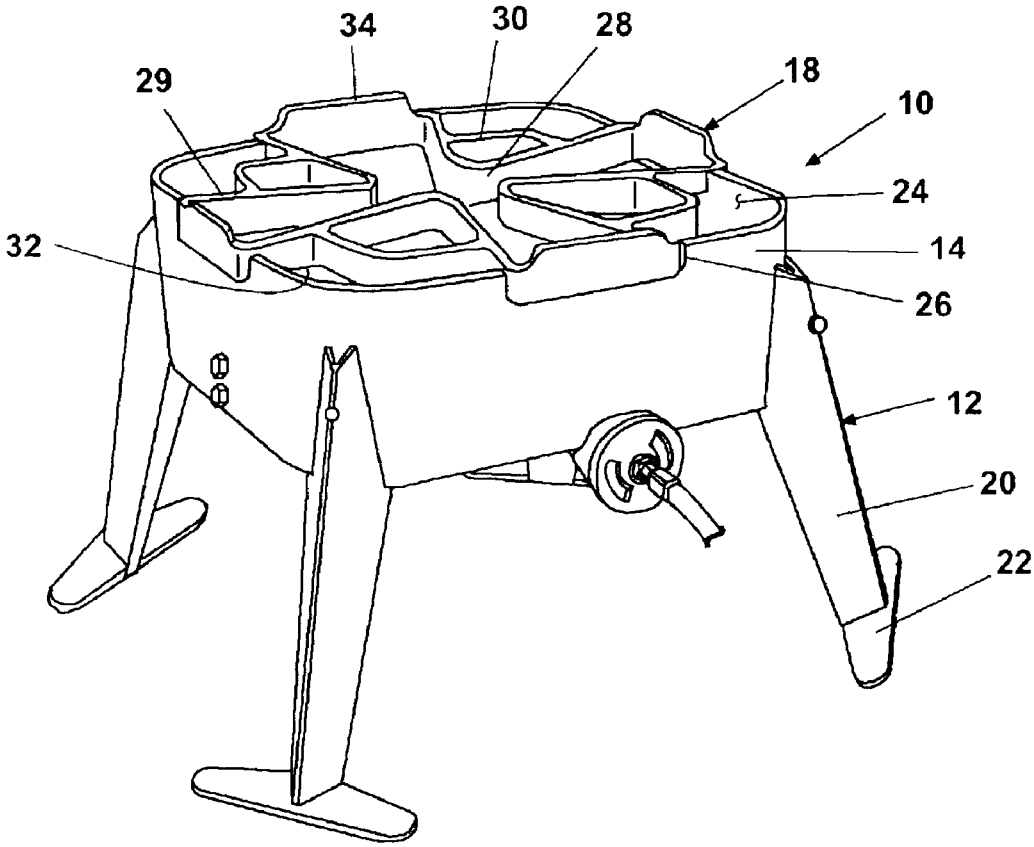
FIG. 6 is a perspective view of the portable cook stove in FIG. 1, wherein the cooking pot support is shown in the guard position with the upright peripheral tabs directed upward relative to the wall of the cook stove.
Figure 7:
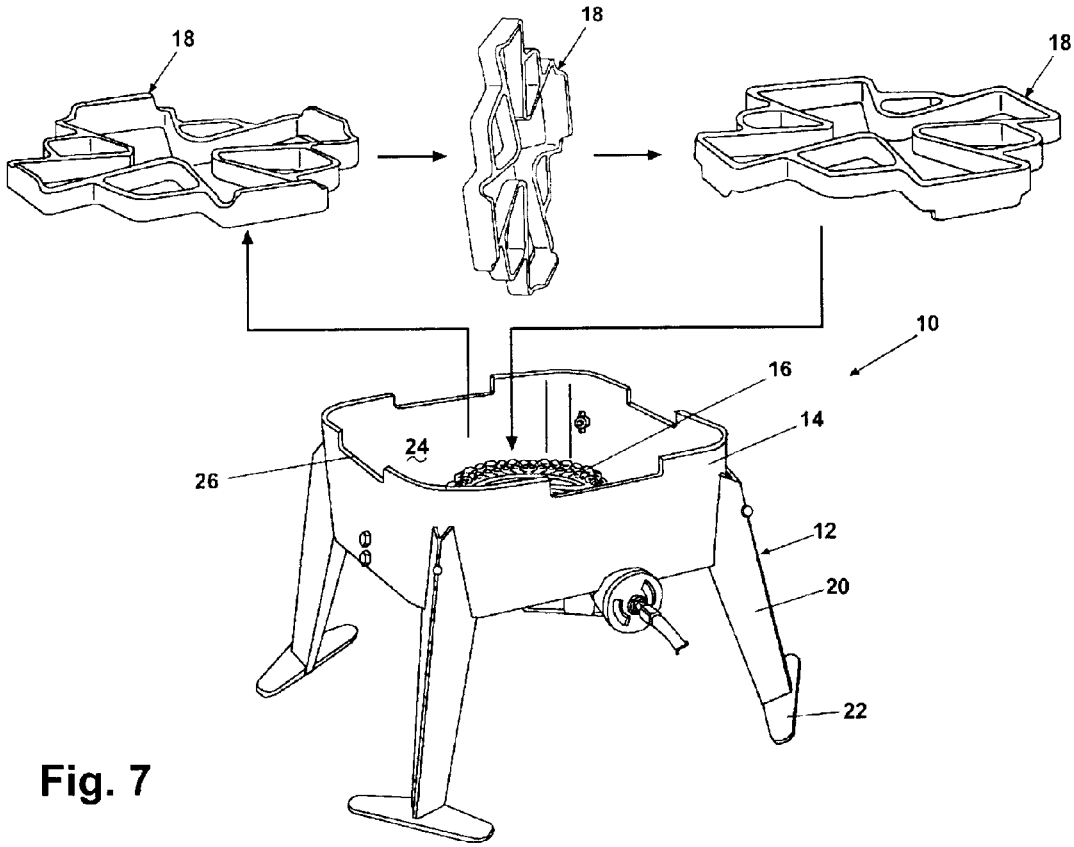
FIG. 7 is a perspective view of the portable cook stove of FIG. 1, wherein the cooking pot support is shown removed from engagement with the upper edge of the cook stove and in process of being flipped from an orientation representative of the guard position to an orientation representative of an inverted position.
Figure 8:
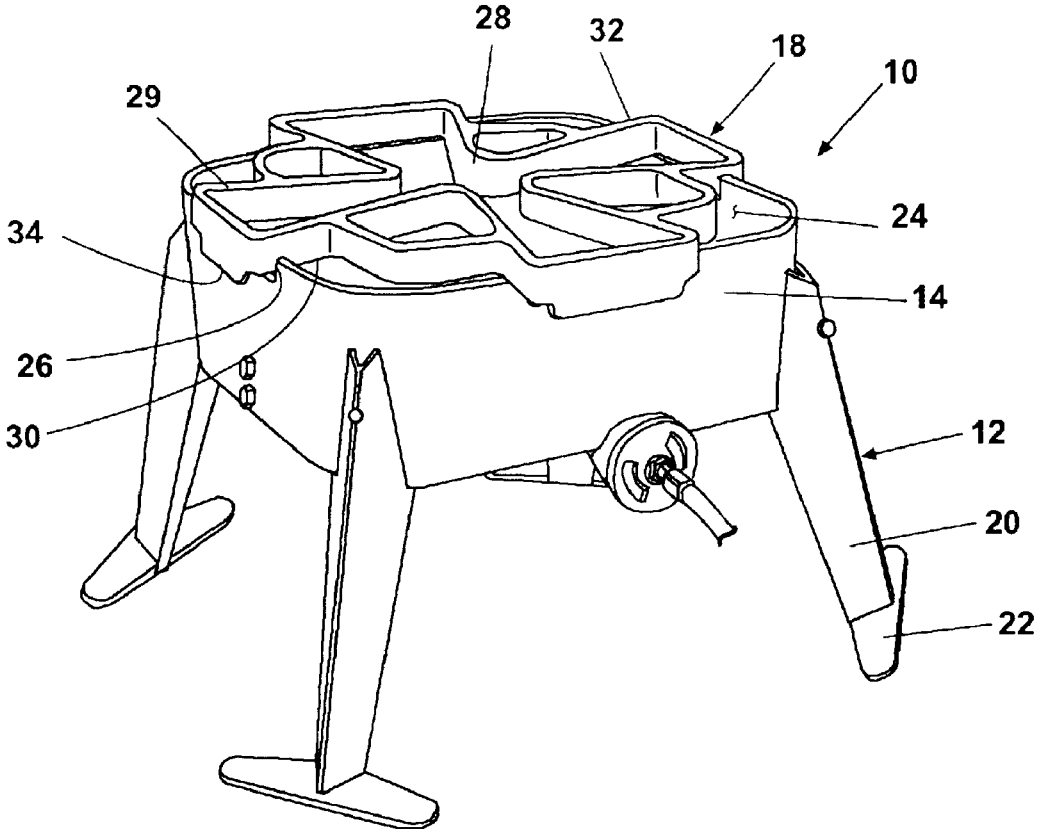
FIG. 8 is a perspective view of the portable cook stove in FIG. 1, wherein the cooking pot support is shown in an inverted position with the upright peripheral tabs directed downward relative to the wall of the cook stove.

Referring now to FIGS. 6–8, the portable cook stove 10 is assembled by placing the cooking pot support 18 on the base 12. This can be accomplished by aligning the mounting portions 29 of the grate 28 with the mounting grooves 26 of the base 12 and lowering the cooking pot support 18 onto the base 12 over the central opening 24 such that the cooking pot support 18 is generally transverse to the base 12. Proper alignment of the mounting portions 29 with the grooves 26 prevents lateral movement of the cooking pot support 18 relative to the base 12.

The cooking pot support 18 can be situated in a guard position, shown in FIG. 6, with the upstanding peripheral tabs 34 and the first cooking surface 30 directed upward relative to the base 12, or alternatively, the cooking pot support 18 can be removed from the cook stove 10 and flipped over (see FIG. 7), and placed in an inverted position, shown in FIG. 8, with the upstanding peripheral tabs 34 and first cooking surface 30 directed downward relative to the base 12.

Figure 9:
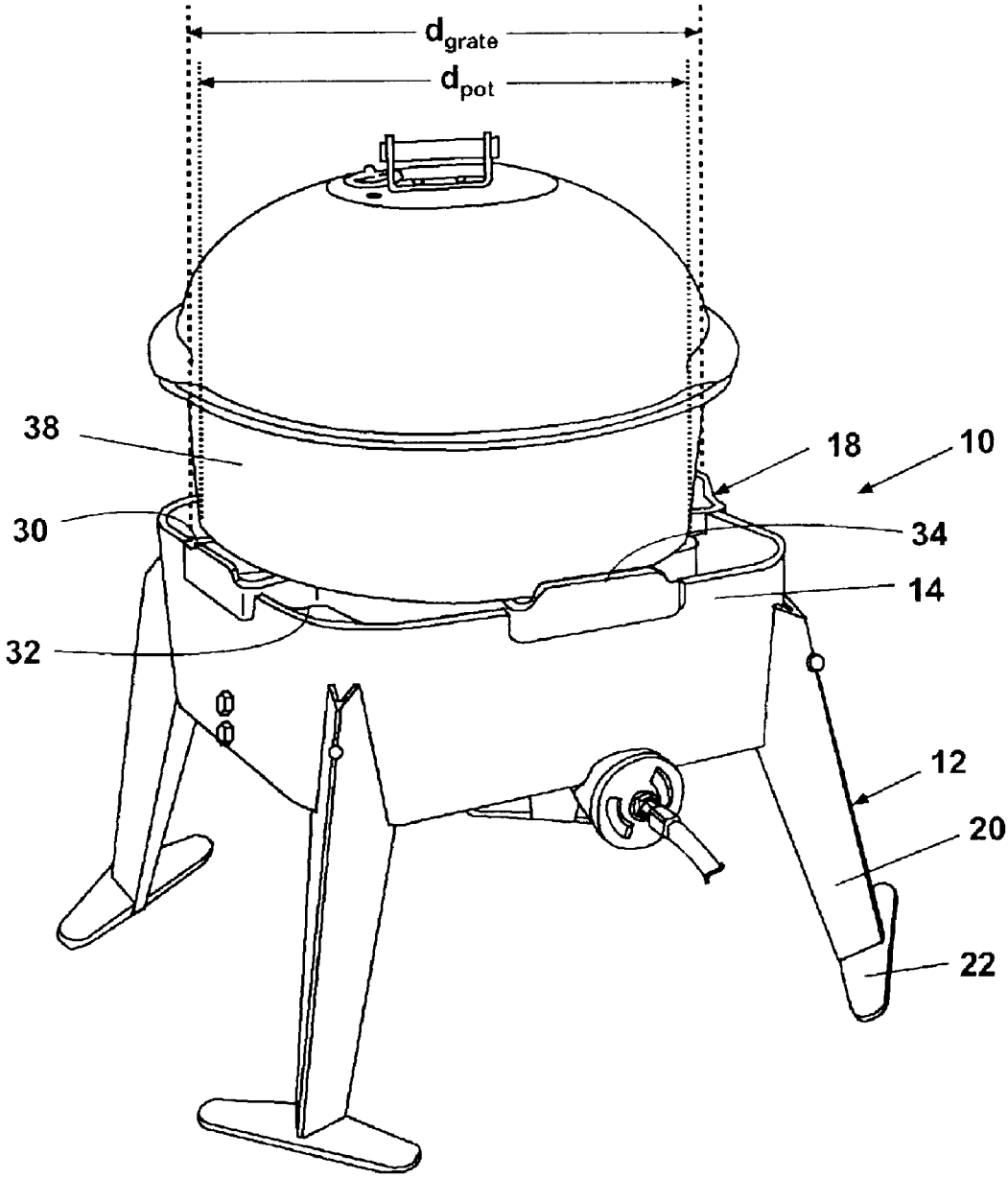
FIG. 9 is a perspective view of the portable cook stove in FIG. 1 with a cooking pot, having an effective outer diameter less than a width (inner diameter) of the tabs, positioned on the cooking pot support in the guard position, wherein the upright peripheral tabs retain the cooking pot on the surface of the cooking pot support.
Figure 10:
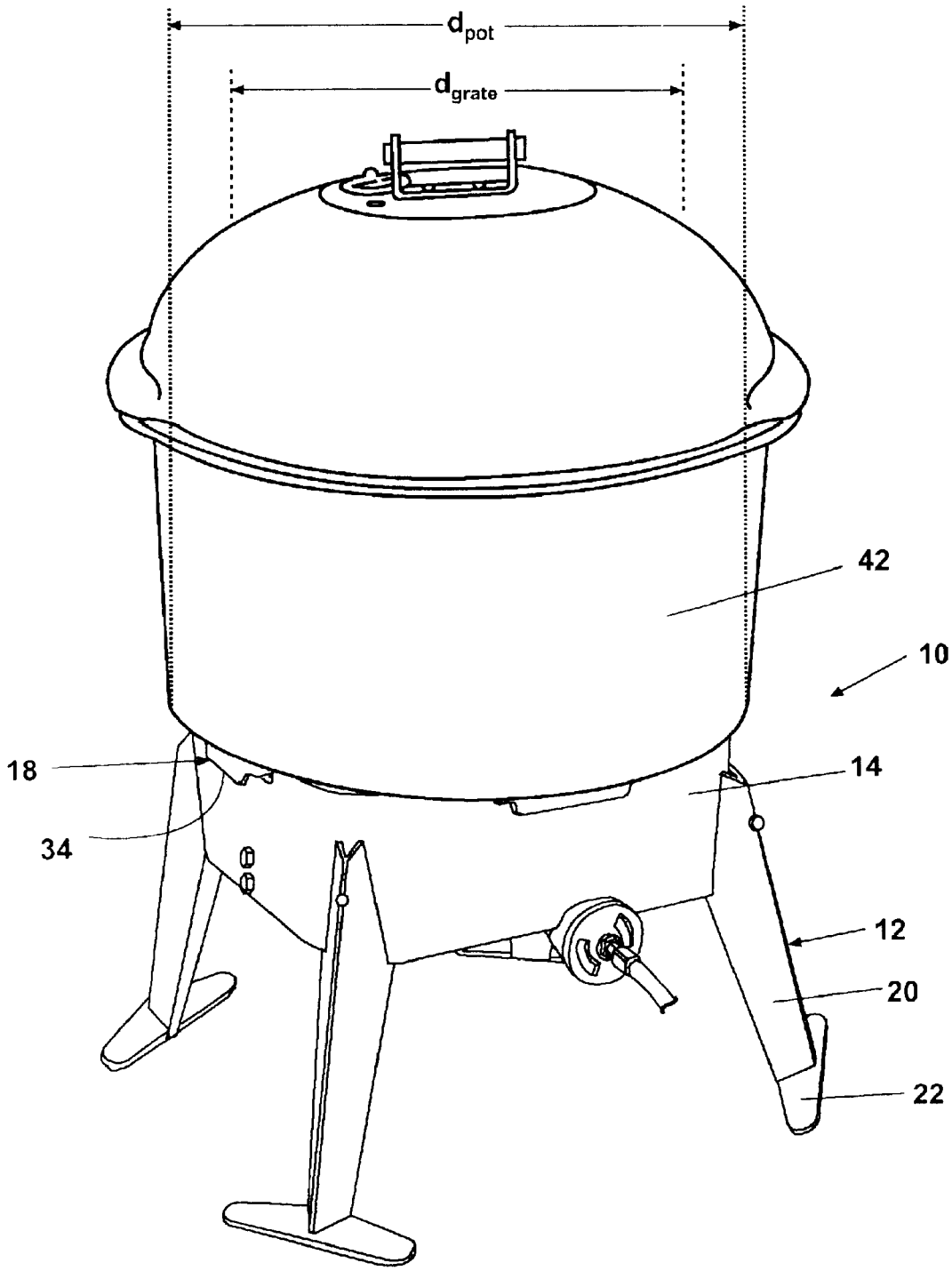
FIG. 10 is a perspective view of the portable cook stove in FIG. 1 with a cooking pot, having an effective outer diameter larger than a width (inner diameter) of the tabs, positioned on the cooking pot support in the inverted position.

In either configuration, the mounting portions 29 protrude beyond the effective outer diameter of the wall 14. As shown in FIG. 9, when a cooking pot 38 having an effective pot diameter $d_{pot}$ at or less than the effective inner diameter $d_{grate}$ is employed, the cooking pot support 18 is preferably oriented in the guard position so that the upstanding peripheral tabs 34 are directed upwardly to create a guard against slippage of the cooking pot 38 with respect to the cooking pot support 18 or at least to prevent the cooking pot 38 from sliding off the first cooking surface 30 of the cooking pot support 18. When a cooking pot 42 having an effective pot diameter $d_{pot}$ greater than the effective inner diameter $d_{grate}$ is utilized, as in FIG. 10, the cooking pot support 18 is preferably oriented in the inverted position so that the peripheral tabs 34 are directed downwardly with respect to the base 12 and do not create an obstruction to using the cooking pot 42. In this orientation, the cooking pot 42 rests on the second cooking surface 32.

Figure 11:
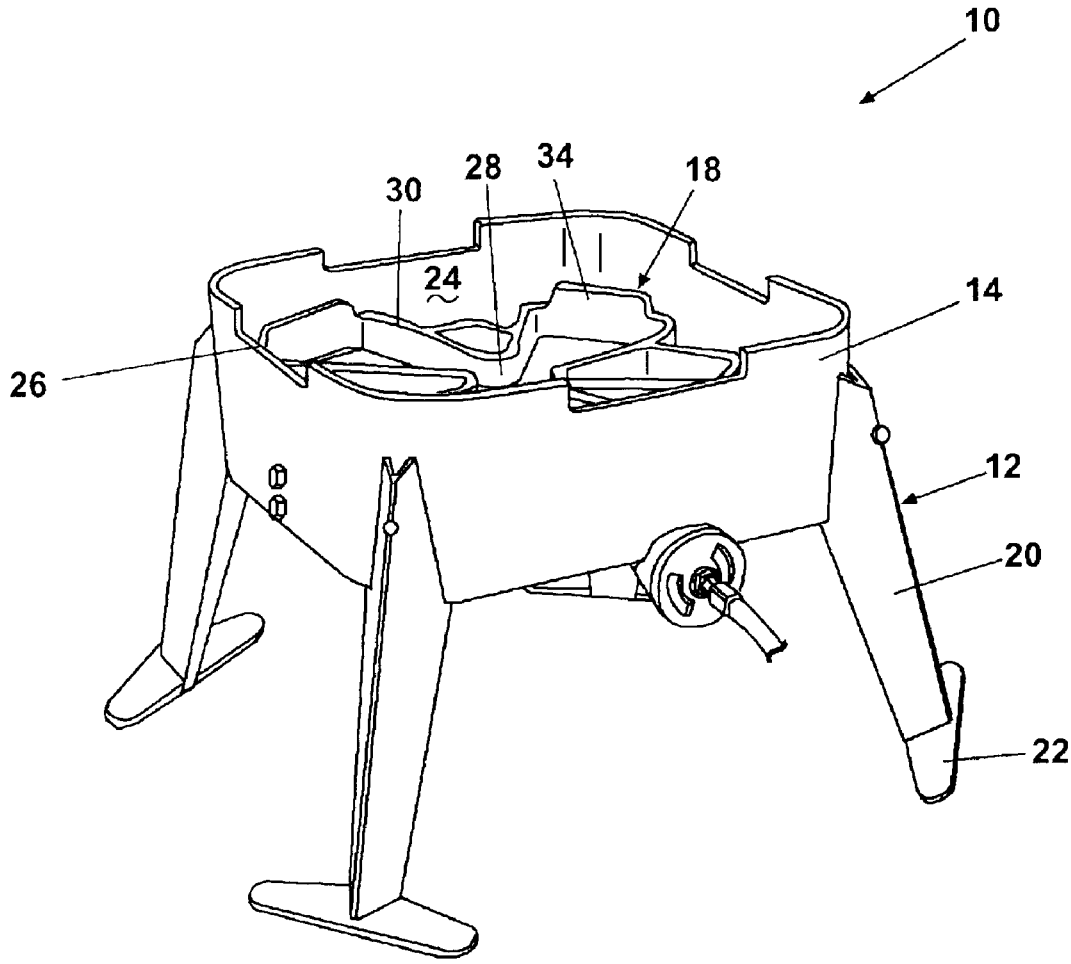
FIG. 11 is a perspective view of the portable cook stove in FIG. 1 with the cooking pot support turned at a 45-degree angle and positioned inside the wall of the cook stove for shipping.

When the portable cooking stove 10 is not in use, it can easily be stored by removing the cooking pot support 18 from the base, rotating the cooking pot support 18 clockwise or counterclockwise 45 degrees such that the extending portions 29 point towards the corners of the square wall 14, and placing the cooking pot support 18 within in the central opening 24 of the wall 14, as illustrated in FIG. 11. This configuration also permits the portable cooking stove 10 to be packaged in a smaller shipping carton and would thus occupy less space in transoceanic shipping containers in common carriers and the like. The cooking stove 10 thus also occupies less warehousing shelf space, less shelf space in a wholesale or retail outlet and, in the end, less collapsed space in an end user's home or vehicle during travel (such as vacationing).

Figure 12:
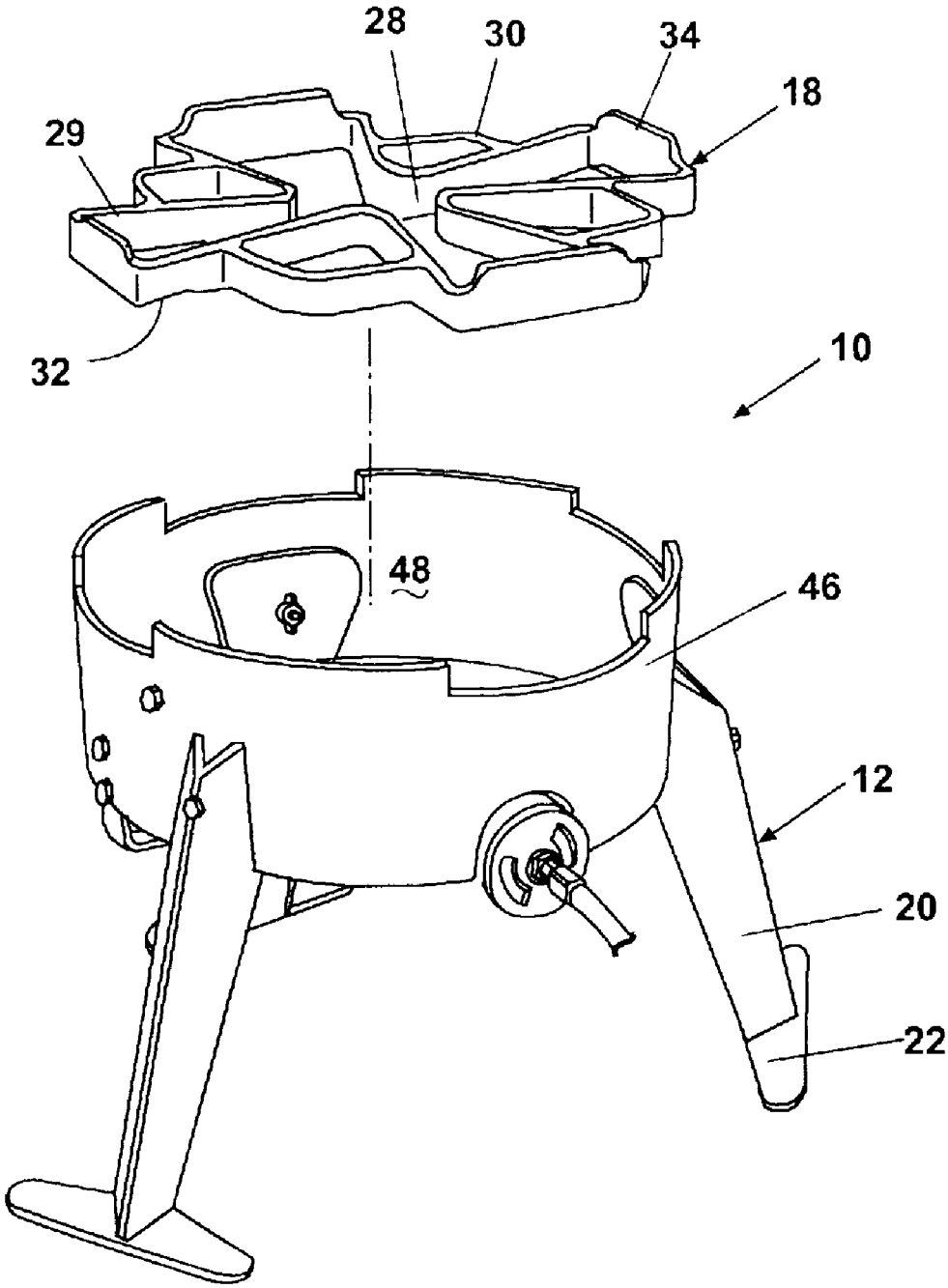
FIG. 12 is an exploded perspective view of an alternative embodiment of the portable cook stove of FIG. 1 with a ground-engaging base connected to a vertically-open wall, shown in a generally round configuration, and a reversible cooking pot support having upstanding peripheral tabs, wherein the support is shown in the guard position with the upright peripheral tabs directed upward relative to the wall.
Figure 13:
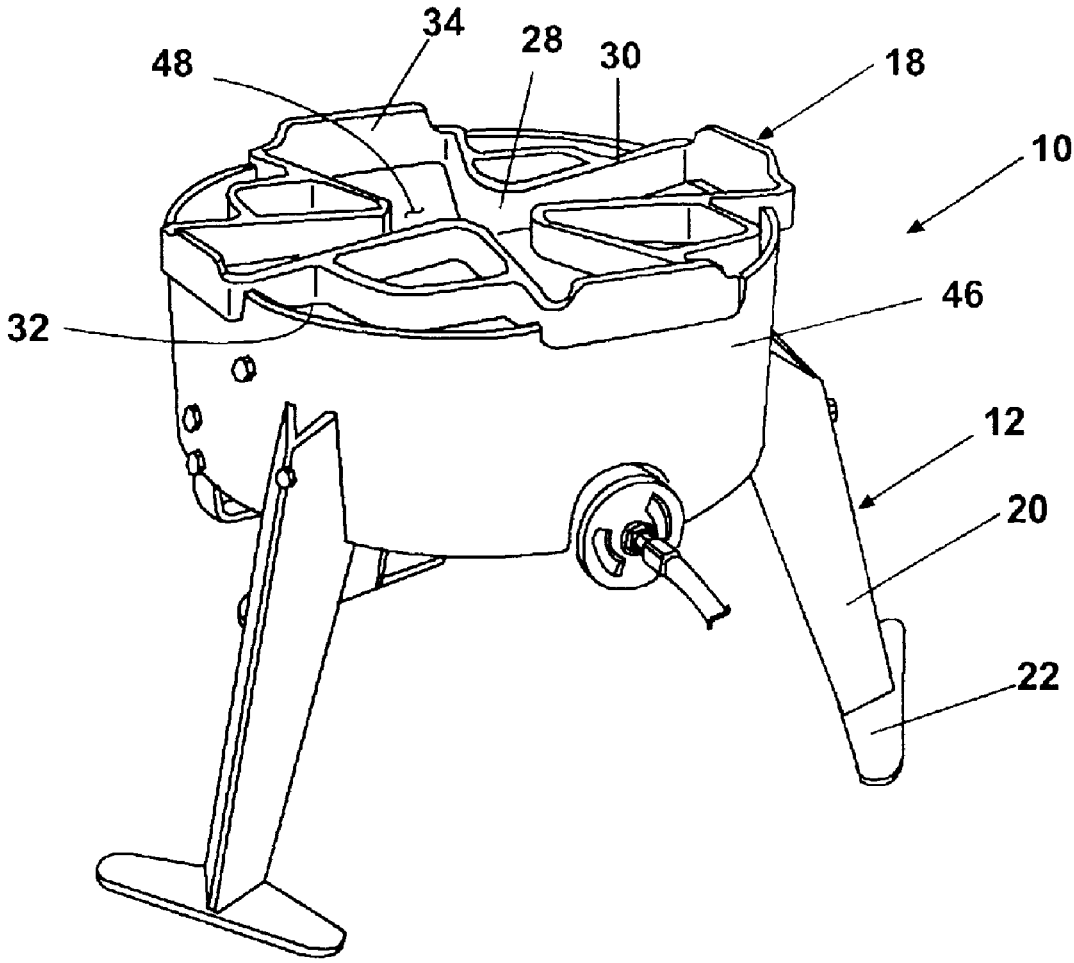
FIG. 13 is a perspective view of the portable cook stove in FIG. 12, wherein the cooking pot support is shown in the guard position with the upright peripheral tabs directed upward relative to the wall.
Figure 14:
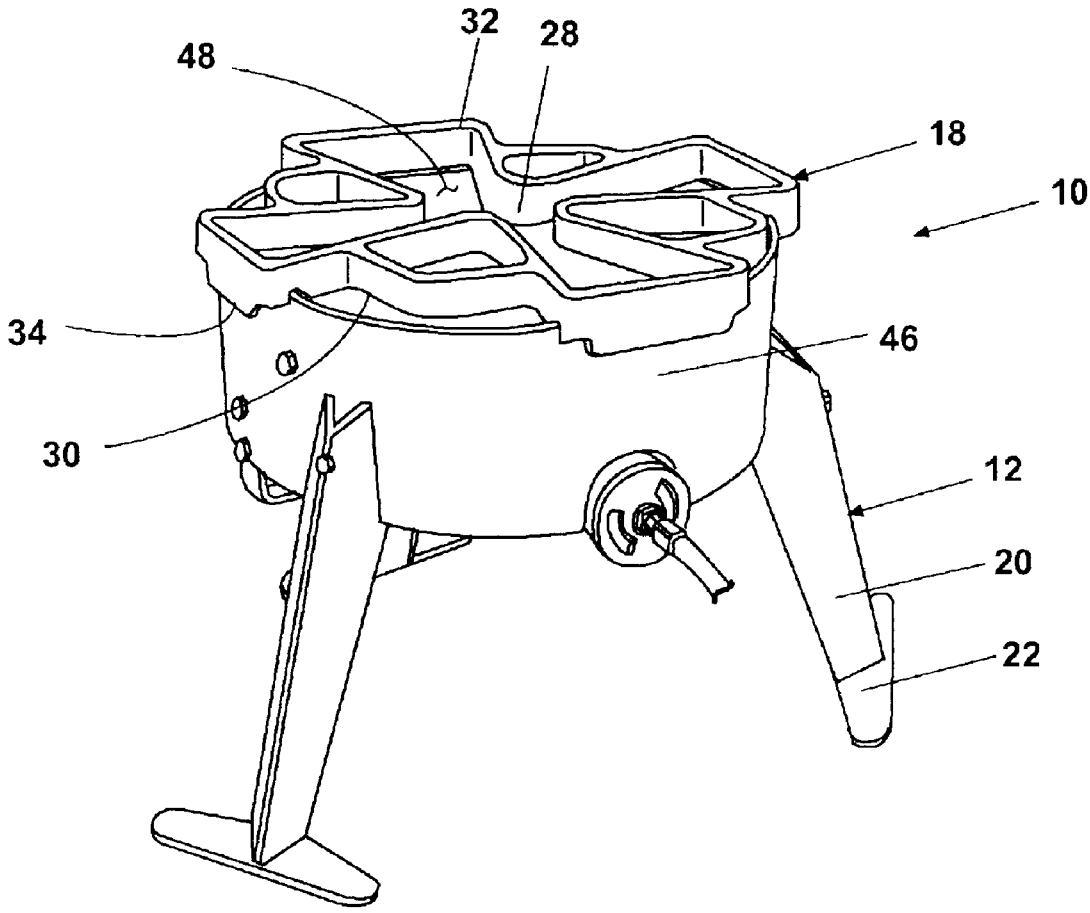
FIG. 14 is a perspective view of the portable cook stove in FIG. 12, wherein the cooking pot support is shown in the reverse position with the upright peripheral tabs directed downward relative to the round wall.

An alternative embodiment is shown in FIGS. 12–14, where it can be seen that like elements common to the first embodiment of FIGS. 1–11 carry like reference numerals. The principle difference is that the base 12 of the second embodiment comprises a generally round wall 46 with a round central opening 48. Otherwise, the portable cook stove 10 of the second embodiment is identical to the first, including use of the same cooking pot support 18. Further, the round wall 46 comprises the same mounting grooves 26 for sustaining the cooking pot support 18.

Operation of the second embodiment of the portable cook stove 10 is the same as described above for the first embodiment. The cooking pot support 18 can be oriented on the base 12 in the guard position with the upstanding peripheral tabs 34 directed upward, as in FIG. 13, or alternatively, the cooking pot support 18 can be situated on the base 12 in the reverse position with the peripheral tabs 34 directed downward, as in FIG. 14, to accommodate for large cooking vessels.

It should be noted that the first cooking surface 30 has a rounded configuration (due to the cast molding nature of the grate), the second cooking surface 32 has a planar configuration and that the second cooking surface grate members are wider (see the upward taper in FIG. 4). Thus, while the tabs 34 prevent slidable movement of a vessel with respect to the first cooking surface 30, the second cooking surface also resists slidable movement of the cooking vessel because of the increased surface area of the second cooking surface 32 (i.e., the increased frictional surface area due to the planar configuration and wider configuration of the second cooking surface). Also, the first and second cooking surfaces 30 and 32 can be provided with a textured or knurled surface to further increase the frictional resistance to sliding of a cooking vessel thereagainst.

The portable cook stove 10 described herein has several benefits. When the cooking pot support 18 is employed in the guard position, cooking pots and other cooking vessels are securely retained on the first cooking surface 30, and, therefore, hot cooking vessels are restrict from falling off the support 18 and onto the ground. As a result, potential danger to the environment and personal property is avoided. Furthermore, by maintaining cooking vessels on the cooking support 18, the current invention reduces the potential that hot liquids often contained in cooking vessels will splash, and thus reduces the potential for harm. In either position, the support 18 locks against the cook stove 10 by the engagement within the grooves and is prevented from lateral movement in any direction with respect to the cook stove 10.

In addition to safety considerations, the portable cook stove 10 is versatile, convenient, and easy to use. All sizes and shapes of cookware can be utilized with the invention. If a cooking vessel is too large to fit on the first cooking surface when the support 18 is in the guard position, the user simply flips over the support 18 to adapt to the size of the cooking vessel. The design is functional yet simple enough for the average user to use without difficulty. The cook stove 10 with the square wall 14 provides the added benefit of compact storage of the cooking pot support 18; the manufacturer can ship the cook stove 10 in a smaller package, and the user can efficiently pack the cook stove 10 for future use.

While the particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

What is claimed is:

1. A portable cook stove adapted for supporting a cooking pot thereon, the cooking pot defining an effective pot diameter, comprising:

a ground engaging base;

a wall mounted to the base having a closed configuration defining a periphery with an effective outer diameter, wherein the wall has an upper portion and defines a central opening therethrough, wherein the upper portion of the wall includes a discontinuous mounting portion;

at least one cooking pot support mounted to the wall in a generally transverse orientation to the wall and extending into the central opening, a portion of the cooking pot support received by the discontinuous mounting portion to prevent lateral movement of the cooking pot support with respect to the wall, the cooking pot support having a first cooking surface juxtaposed with a second cooking surface, the first cooking surface having an upstanding peripheral tab thereon defining an effective inner diameter; the at least one cooking pot support defining a cooking pot support surface for supporting the cooking pot thereon; and a burner mounted to the wall in a generally coaxial configuration with the central opening, the burner adapted to be operably interconnected with a source of fuel;

whereby, when a cooking pot having an effective pot diameter at or less than the effective inner diameter is employed, the cooking pot support can be oriented with respect to the wall so that the upstanding peripheral tabs are directed upwardly creating a guard against slippage of the cooking pot with respect to the cooking pot support, and when a cooking pot having an effective pot diameter greater than the effective inner diameter is employed, the cooking pot support can be oriented with respect to the wall so that the peripheral tabs are directed downwardly and do not create an obstruction to using the larger cooking pot.

2. The portable cook stove of claim 1 wherein the discontinuous mounting portion comprises a plurality of grooves in the upper portion of the wall at radially-spaced intervals.

3. The portable cook stove of claim 2 wherein the cooking pot support has at least one mounting portion in close alignment with the radially-spaced plurality of grooves in the upper portion of the wall, whereby when the mounting portion is positioned within the plurality of grooves, lateral movement of the cooking pot support with respect to the wall is resisted.

4. The portable cook stove of claim 1 wherein the wall has a square configuration.

5. The portable cook stove of claim 4 wherein the cooking pot support is configured so as to nest within the confines of the wall when canted at an angle with respect to the wall.

6. The portable cook stove of claim 1 wherein the cooking pot support is comprised of a latticework forming openings between adjacent lattices.

7. The portable cook stove of claim 1 wherein the wall has a round configuration.

8. A portable cook stove comprising:

a ground-engaging base with a wall upstanding therefrom, the wall defining an open central recess therethrough, the wall having at least one support mounting portion thereon at an upper portion thereof;

a burner mounted to at least one of the base and the wall, the burner being positioned within the open central recess in the wall, the burner being operably connectable to a source of ignitable fuel;

a cooking pot support having a first surface and an opposed second surface, each of the first surface and the second surface having at least one mounting portion in register with the at least one mounting portion on the wall, wherein the cooking pot support can be mounted generally transversely to the wall by receipt of the at least one mounting portion on one of the first and second surfaces with the at least one mounting portion on the wall, and wherein the cooking pot support has a guard extending upwardly from one of the first and second surfaces;

whereby the guard prevents slidable movement of a cooking pot relative to the cooking pot support, when a cooking pot is placed onto the cooking pot support when the guard is oriented upwardly with respect to the one of the first and second surfaces.

9. The cook stove of claim 8 wherein the guard comprises a plurality of upstanding tabs extending upwardly from a periphery of the one of the first and second surfaces.

10. The cook stove of claim 9 wherein the mounting portion of the wall comprises at least one groove in the upper portion of the wall which is adapted to receive a corresponding one of the at least one mounting portion on the cooking pot support.

11. The cook stove of claim 10 wherein each of the at least one groove in the wall comprises a generally rounded rectangular groove.

12. The cook stove of claim 11 wherein each of the plurality of tabs is generally flush with the periphery of the cooking pot support and extends upwardly from the one of the first and second surfaces.

13. The cook stove of claim 8 wherein the mounting portion of the wall comprises at least one groove in the upper portion of the wall which is adapted to receive a corresponding one of the at least one mounting portion on the cooking pot support.

14. The cook stove of claim 13 wherein each of the at least one groove in the wall comprises a generally rounded rectangular groove.

15. A method of configuring a cook stove having a generally transverse cooking pot support at an upper portion thereof, the cooking pot support having an effective inner diameter, to function with cooking pots with both an effective pot diameter less than the effective inner diameter of the cooking pot support and greater than the effective inner diameter, the method comprising the steps of:

providing a guard extending upwardly from one of a first surface and an opposed second surface of the cooking pot support, the guard defining the effective inner diameter of the cooking pot support on the one of a first surface and an opposed second surface of the cooking pot support;

selecting a cooking pot having an effective cooking pot diameter desired to be employed with the cookstove;

comparing the effective inner diameter of the cooking pot support with the effective cooking pot diameter; and orienting the cooking pot support on the cook stove so that the guard is pointing upwardly if the comparing step determines that the effective inner diameter is greater than the effective cooking pot diameter, and so that the guard is pointing downwardly if the comparing step determines that the effective inner diameter is less than the effective cooking pot diameter so that the guard does not obstruct placement of the cooking pot onto the cooking pot support.

16. The method of claim 15 and further comprising the step of placing the selected cooking pot on the oriented cooking pot support.

17. The method of claim 16 and further comprising the step of operating the cook stove in a normal mode of use to prepare cooked food in the selected cooking pot.

18. The method of claim 17 and further comprising the step of reorienting the cooking pot support when a cooking pot of one of a lesser and greater diameter is later selected.

19. The method of claim 15 and further comprising the step of operating the cook stove in a normal mode of use to prepare cooked food in the selected cooking pot.

20. The method of claim 15 and further comprising the step of reorienting the cooking pot support when a cooking pot of one of a lesser and greater diameter is later selected.

* * * * *